US010688776B2

(12) United States Patent
Bangel

(10) Patent No.: US 10,688,776 B2
(45) Date of Patent: Jun. 23, 2020

(54) WEB-FED PRINTING MACHINE INCLUDING PROCESSING MODULES AND CARRIER MODULES

(71) Applicant: GALLUS DRUCKMASCHINEN GMBH, Langgoens-Oberkleen (DE)

(72) Inventor: Dieter Bangel, Huettenberg (DE)

(73) Assignee: Gallus Druckmaschinen GmbH, Langgoens-Oberkleen (DE)

( * ) Notice: Subject to any disclaimer, the term of this patent is extended or adjusted under 35 U.S.C. 154(b) by 182 days.

(21) Appl. No.: 15/654,993

(22) Filed: Jul. 20, 2017

(65) Prior Publication Data

US 2018/0022080 A1 Jan. 25, 2018

(30) Foreign Application Priority Data

Jul. 22, 2016 (DE) ..... 10 2016 213 438

(51) Int. Cl.

| | |
|---|---|
| ***B41F 5/04*** | (2006.01) |
| ***B41F 13/20*** | (2006.01) |
| ***B41F 13/00*** | (2006.01) |
| ***B41F 13/36*** | (2006.01) |
| ***B41F 13/34*** | (2006.01) |
| ***B41F 13/14*** | (2006.01) |
| ***B41F 13/12*** | (2006.01) |
| ***B41F 19/00*** | (2006.01) |
| ***B41F 13/62*** | (2006.01) |
| *B41J 29/02* | (2006.01) |

(52) U.S. Cl.

CPC ..... *B41F 5/04* (2013.01); *B41F 13/0024* (2013.01); *B41F 13/12* (2013.01); *B41F 13/14* (2013.01); *B41F 13/34* (2013.01); *B41F 13/36* (2013.01); *B41F 13/62* (2013.01); *B41F 19/00* (2013.01); *B41J 29/02* (2013.01); *B41P 2217/11* (2013.01)

(58) Field of Classification Search

CPC .... B41F 5/04; B41F 5/24; B41F 13/62; B41F 13/12; B41F 13/34; B41F 13/36; B41F 13/20; B41F 13/0024; B41P 2217/11

USPC ..... 101/479, 480

See application file for complete search history.

(56) References Cited

U.S. PATENT DOCUMENTS

| | | | |
|---|---|---|---|
| 4,384,522 | A | 5/1983 | Ehlers et al. |
| 4,960,048 | A | 10/1990 | Sarda |
| 5,019,046 | A | 5/1991 | Kohler |

(Continued)

FOREIGN PATENT DOCUMENTS

| | | | |
|---|---|---|---|
| DE | 19513536 | A1 | 10/1996 |
| DE | 602004009587 | T2 | 7/2008 |

(Continued)

*Primary Examiner* — Leslie J Evanisko

(74) *Attorney, Agent, or Firm* — Laurence A. Greenberg; Werner H. Stemer; Ralph E. Locher

(57) ABSTRACT

A web-fed printing machine that is highly variable in terms of its configuration, provides a high degree of positioning accuracy of processing modules and has a cost-efficient machine frame, includes a plurality of the processing modules fixed to the machine frame. Each respective processing module is advantageously fixed to the machine frame by a respective carrier module. Every carrier module includes two parallel longitudinal beams extending in the machine direction and two parallel crossbars which are oriented at right angles to the longitudinal beams and which interconnect the two longitudinal beams.

12 Claims, 10 Drawing Sheets

(56) References Cited

U.S. PATENT DOCUMENTS

| | | | | |
|---|---|---|---|---|
| 5,060,569 | A | 10/1991 | Gladow | |
| 5,074,205 | A | 12/1991 | Morgan | |
| 5,275,105 | A * | 1/1994 | Schweizer | B41F 13/34 101/216 |
| 5,697,297 | A | 12/1997 | Rasmussen | |
| 5,784,964 | A * | 7/1998 | Rodi | F16M 1/08 101/219 |
| 7,878,352 | B2 | 2/2011 | Spreckelsen et al. | |

FOREIGN PATENT DOCUMENTS

| | | | |
|---|---|---|---|
| DE | 102012003157 | A1 | 8/2013 |
| EP | 0350404 | A1 | 1/1990 |
| EP | 1932667 | A1 | 6/2008 |
| WO | 9529813 | A1 | 11/1995 |

* cited by examiner

WEB-FED PRINTING MACHINE INCLUDING PROCESSING MODULES AND CARRIER MODULES

CROSS-REFERENCE TO RELATED APPLICATION

This application claims the priority, under 35 U.S.C. § 119, of German Patent Application DE 10 2016 213 438.8, filed Jul. 22, 2016; the prior application is herewith incorporated by reference in its entirety.

BACKGROUND OF THE INVENTION

Field of the Invention

The invention relates to a web-fed printing machine for printing on a substrate web being transported through the web-fed printing machine in a machine direction and being processed. The machine includes a machine frame and a plurality of processing modules fixed thereto.

Printing machines that print labels or folding boxes are increasingly expected to be highly flexible or variable to be able to process the greatest possible variety of print jobs, in particular print jobs that include printed images or printed text with special optical effects. The printing machines that are used to produce labels and folding boxes are very frequently printing machines that process a narrow web of printing material and include a plurality of connecting platforms or interfaces for connecting and removing a respective functional unit or processing module for printing in accordance with a specific printing process. An embodiment of such a printing machine is described, for instance, in U.S. Pat. No. 4,384,522. The individual functional units thereof may operate in accordance with different printing processes.

German Patent Application DE 195 13 536 A1, corresponding to U.S. Pat. No. 6,019,046, and International Publication WO 95/29813, corresponding to U.S. Pat. No. 5,697,297, disclose printing machines that include a plurality of printing units disposed in line and allow a number of functional units or processing modules to be connected and disconnected at a plurality of connecting platforms. Among other elements, the functional units may include printing units or parts of printing units disposed in cartridges or attachment modules and operating in accordance with a letterpress process, flexographic printing process, screen printing process, lithographic offset printing process, gravure process, or inkjet printing process. In addition, there are functional units (processing units) that allow a mechanical treatment of the printing material, for instance providing an embossment or cuts (perforations or punched holes) or reversing the sheet. Such printing machines that may operate in accordance with a plurality of different printing processes are also known as combination printing presses or hybrid printing machines.

For many years, the machine frames of printing presses have for a large part been made of metal materials, in particular of different types of steel. Printing machines for modern printing technologies mostly use large cast parts or massive or solid steel plates as the supporting structure of the machine. Those elements are formed in technically complex and often costly processing steps. That complex treatment is necessary to provide the receiving locations for processing modules at precisely the right position in the supporting structure. Thus, the machine frame of a printing press and the costs of material account for a large proportion of the total cost of a printing machine.

SUMMARY OF THE INVENTION

It is accordingly an object of the invention to provide a web-fed printing machine including processing modules and carrier modules, which overcome the hereinafore-mentioned disadvantages of the heretofore-known machines of this general type, which is highly variable in terms of its configuration, which allows processing modules to be connected in precisely the right location and which has a cost-efficient machine frame.

With the foregoing and other objects in view there is provided, in accordance with the invention, a web-fed printing machine for printing on a substrate web being transported through the web-fed printing machine in a machine direction and being processed. The machine includes a machine frame and a plurality of processing modules fixed thereto. A respective processing module is fixed to the machine frame by using a respective carrier module. Every carrier module includes two parallel longitudinal beams extending in the machine direction and two crossbars being oriented at right angles to the longitudinal beams, being parallel to one another and interconnecting the two longitudinal beams. A respective processing module is supported by the crossbars of at least one carrier module, and the longitudinal beams are supported by the machine frame.

The web-fed printing machine of the invention is used to print on a web of a substrate such as paper, plastic, or composite material, in particular also for producing labels. The web of a substrate is transported through the web-fed printing machine in a machine direction to be processed in the machine. The web-fed printing machine has a machine frame and a number of processing modules fixed thereto. The processing modules may, for instance, be flexographic printing units, screen printing units, rotary diecutting units, delaminating devices, laminating devices, driers, longitudinal cutting units, web-pulling units, etc. In accordance with the invention, a respective processing module is fixed to the machine frame by using a respective carrier module, every carrier module includes two parallel longitudinal beams extending in the machine direction and two crossbars disposed to be at right angles to the longitudinal beams and oriented to be parallel to one another and interconnecting the two longitudinal beams. The crossbars may in particular have a circular cross-section. A respective processing module is supported by the crossbars of at least one carrier module and the longitudinal beams are in turn supported by the machine frame. A respective carrier module may have a horizontal, vertical, or angled orientation. The use of such a carrier module advantageously provides a neutral, flat interface between the machine frame and the processing modules, providing a modular construction of the web-fed printing machine and allowing an easy exchange of the processing modules. It is further advantageous if the carrier module has a mirror-symmetrical construction and if the two crossbars as well as the two longitudinal beams are embodied as nonvariable parts. In order to be able to use a plurality of processing modules in the web-fed printing machine, multiple carrier modules supported on the machine frame are provided.

In a first exemplary embodiment of the processing modules, the processing modules have cutouts on their undersides in order to place the processing modules on the crossbars of the carrier modules, the cutouts being constructed to be complementary to the crossbars. In this context, "complementary" is understood to mean that the shape of the cutouts matches the cross-sectional profile of the crossbars in such a way that the crossbars and cutouts are able to engage with one another. The positioning of a processing module in the web-fed printing machine is thus achieved by inserting a respective processing module with its cutouts in the crossbars of a carrier module. Printing units and diecutting units in particular may be constructed in accordance with this embodiment.

Another exemplary embodiment may include processing modules that have cutouts on their top sides. Such modules may be hooked into the crossbars of the carrier modules. In this case, the cutouts are likewise constructed to complement the crossbars. If processing modules that are supported in this suspended way are positioned in the web-fed printing machine, the processing modules need to be fixed to the carrier modules or to the machine frame. This may be achieved by a snap-on or screw-on connection or by any other locking mechanism. Driers may for instance be constructed in accordance with this embodiment.

It is particularly advantageous if the cutouts that correspond with a first beam have contacting surfaces with a prismatic construction to ensure a defined guidance and if the cutouts that correspond with the other beam allow a certain amount of play. This avoids an overdeterminate configuration of the processing modules.

In another particularly advantageous and thus preferred further development, a respective carrier module has a support system for releasably fixing the carrier module to the machine frame in such a way that the carrier module is alignable. In this context, alignable is understood to mean that the carrier module may be adjusted and leveled relative to the machine frame. The support system may in particular fix a carrier module to the upper contact surfaces of two parallel side walls of the machine frame. Thus, the carrier module is not part of the machine frame. In an advantageous embodiment, the support system has adjustable, self-locking leveling elements. Every carrier module may in particular include four leveling elements, with one leveling element disposed in every respective corner of the carrier module. The use of such leveling elements is common practice in the fields of mechanical engineering and plant engineering. Suitable leveling elements are, for instance, GN 355 leveling elements sold by Ganter Griff. These leveling elements include a leveling screw, a cylinder screw with a disk, and a spherical washer, allowing the elements to be adjusted relative to one another and thus allowing the carrier module to be positioned relative to the machine frame. Once the carrier modules have been attached to the machine frame of the web-fed printing machine, they may be positioned with a high degree of accuracy by operating the leveling elements. Thus, the precision requirements for the machine frame itself are much less stringent because the required degree of accuracy of the alignment of the processing modules relative to one another is achieved by positioning, aligning, and leveling the support systems.

In accordance with a further development of the web-fed printing machine of the invention, a positioning rail for positioning a processing module in a direction perpendicular to the machine direction is disposed on the crossbars of a carrier module in such a way to as be movable in a transverse direction. Thus, the lateral register of a processing module may be corrected even during an ongoing print job by moving the positioning rail. In accordance with a particularly advantageous and thus preferred embodiment, a spindle drive is provided on every carrier module to adjust a respective positioning rail. The spindle drive may include a spindle supported in one of the two longitudinal beams, a spindle nut connected to the positioning rail, and a manually operated turning knob or a controllable electric motor for rotating the spindle.

It is furthermore seen as advantageous if the machine frame of the web-fed printing machine has at least a base plate and two parallel side walls of identical height on which the carrier modules may be disposed. The base plate and side walls are preferably manufactured as a welded sheet-metal frame construction. It is even possible to choose a modular construction for the web-fed printing machine, i.e. multiple units formed of a base plate and side walls may be disposed in line relative to one another. Such a machine frame construction is particularly cost-efficient and saves resources.

As far as it makes sense from a technical point of view, combinations of the invention as described above and of the advantageous further developments of the invention likewise form advantageous further developments of the invention.

Other features which are considered as characteristic for the invention are set forth in the appended claims. Further advantages and embodiments of the invention that are advantageous in structural and functional terms will become apparent from the dependent claims and the description of exemplary embodiments with reference to the appended figures.

Although the invention is illustrated and described herein as embodied in a web-fed printing machine including processing modules and carrier modules, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
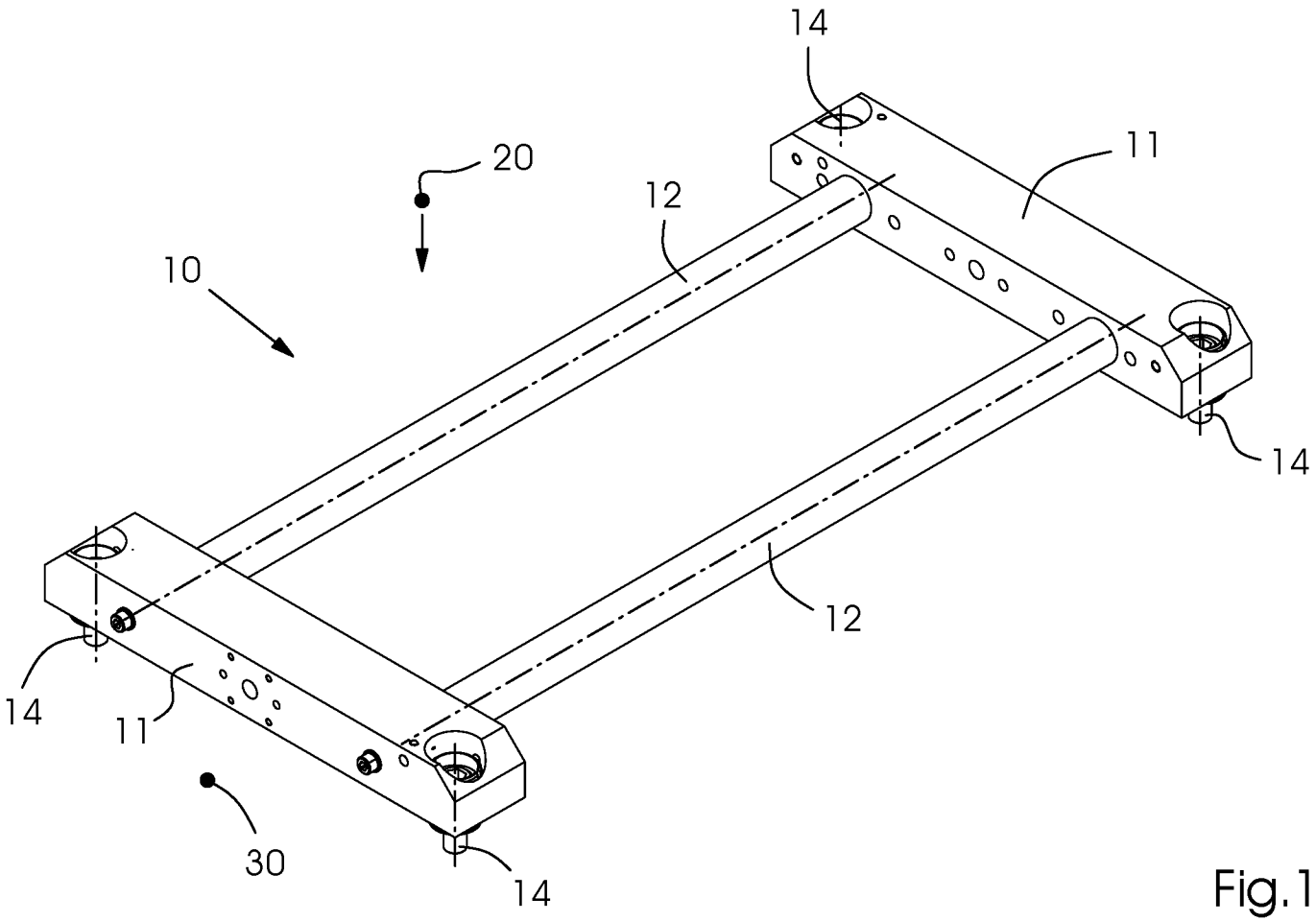
FIGS. 1A and 1B are diagrammatic, perspective views of a first embodiment of a carrier module.
Figure 1B:
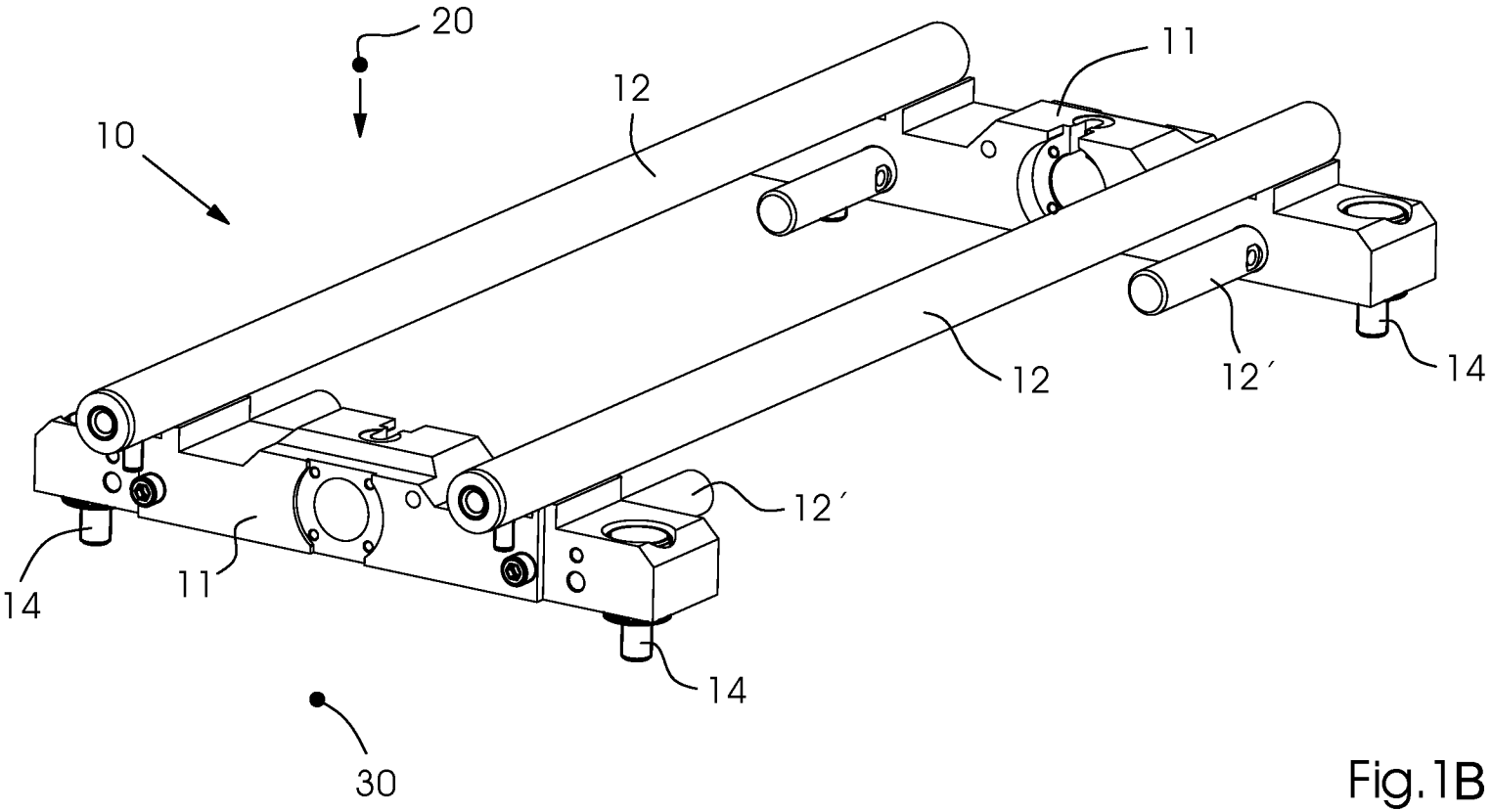

Referring now to the figures of the drawings in detail and first, particularly, to FIGS. 1A and 1B thereof, there is seen a carrier module 10 that may be used to position (non-illustrated) processing modules 20 on a (non-illustrated) machine frame 30. The carrier module 10 is constructed as follows: it has two massive or solid longitudinal beams 11 disposed to be parallel to one another. The longitudinal beams 11 are interconnected by crossbars 12 disposed at right angles to the longitudinal beams 11. The crossbars 12 are disposed to be parallel to one another and may in particular have a circular cross-section, i.e. they may be round bars. A (non-illustrated) processing module 20 may be placed on the crossbars 12 from above or hooked into the crossbars 12 from below. The longitudinal beams 11 of the carrier module 10 do not directly rest on the machine frame 30 but are connected to the machine frame 30 by a support system 13 including leveling elements 14. A carrier module 10 constructed as shown in FIGS. 1A and 1B may be used to receive pulling devices, longitudinal cutting devices, delaminating devices, laminating devices etc., i.e. processing modules 20 that do not require lateral alignment.

Figure 2B:
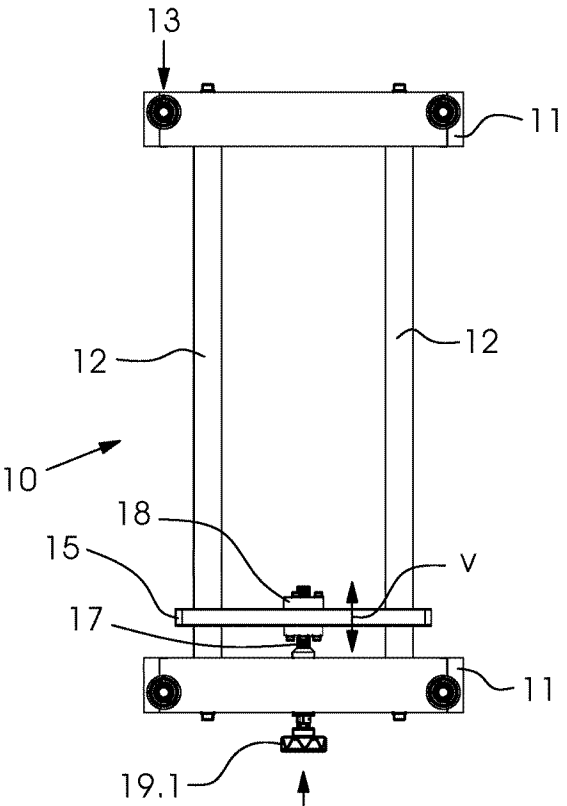
FIGS. 2A and 2B are top-plan views and FIGS. 2C and 2D are perspective views of different embodiments of a carrier module.
Figure 2A:
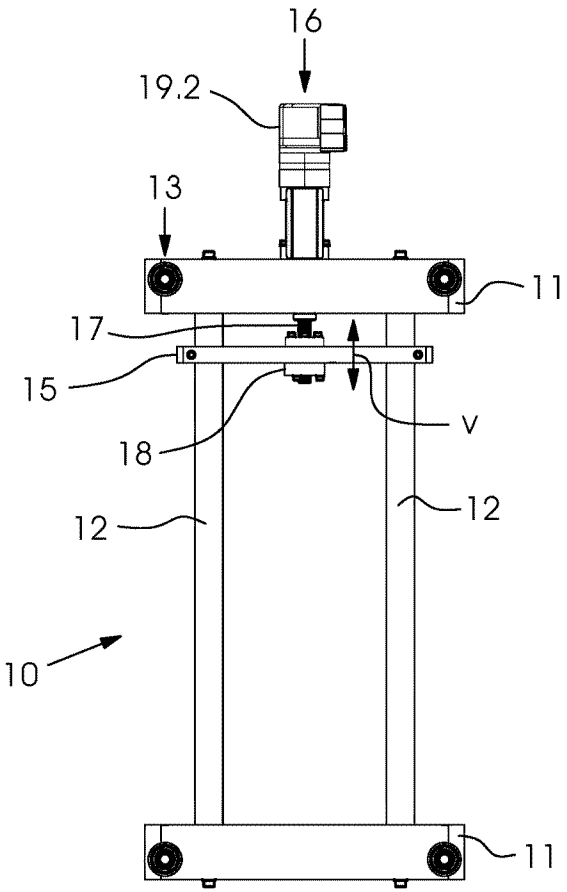

However, if lateral alignment is required, i.e. accurate positioning in a direction perpendicular to the machine direction M (see FIGS. 3, 5A and 6), carrier modules 10 constructed in accordance with the illustration of FIGS. 2A and 2B may be used. The carrier module 10 shown in FIG. 2A is constructed as described above. In addition, it has a positioning rail 15 that is movable in a transverse direction, i.e. it is capable of carrying out a displacing movement v along the crossbars 12. The positioning rail 15 is supported on the crossbars 12. The displacing movement v is achieved by a spindle drive 16, which includes a spindle 17, a spindle nut 18, and an electric motor 19.2 for rotating the spindle 17. The positioning rail 15, which is movable in a transverse direction, with the spindle drive 16 thereof, are disposed on the drive side, i.e. on that side of the web-fed printing machine 100 (see FIGS. 5A, 5B and 6) on which the drives are located, to avoid affecting access to the processing modules due to the fact that the adjustment motor 19.2 protrudes from the carrier module 10.

The carrier module 10 illustrated in FIG. 2B represents an alternative embodiment: it includes a device for manual operation by a machine operator instead of the adjustment motor 19.2. For this purpose, the positioning rail 15, with the spindle drive 16 thereof, are disposed on the operator side, i.e. on that side of the web-fed printing machine 100 that is easily accessible to the machine operator. The spindle drive 16 likewise includes a rotary spindle 17 and a spindle nut 18 fixed to the positioning rail 15. The rotation of the spindle 17 is caused by a manually operated rotary knob 19.1.

Figure 2C:
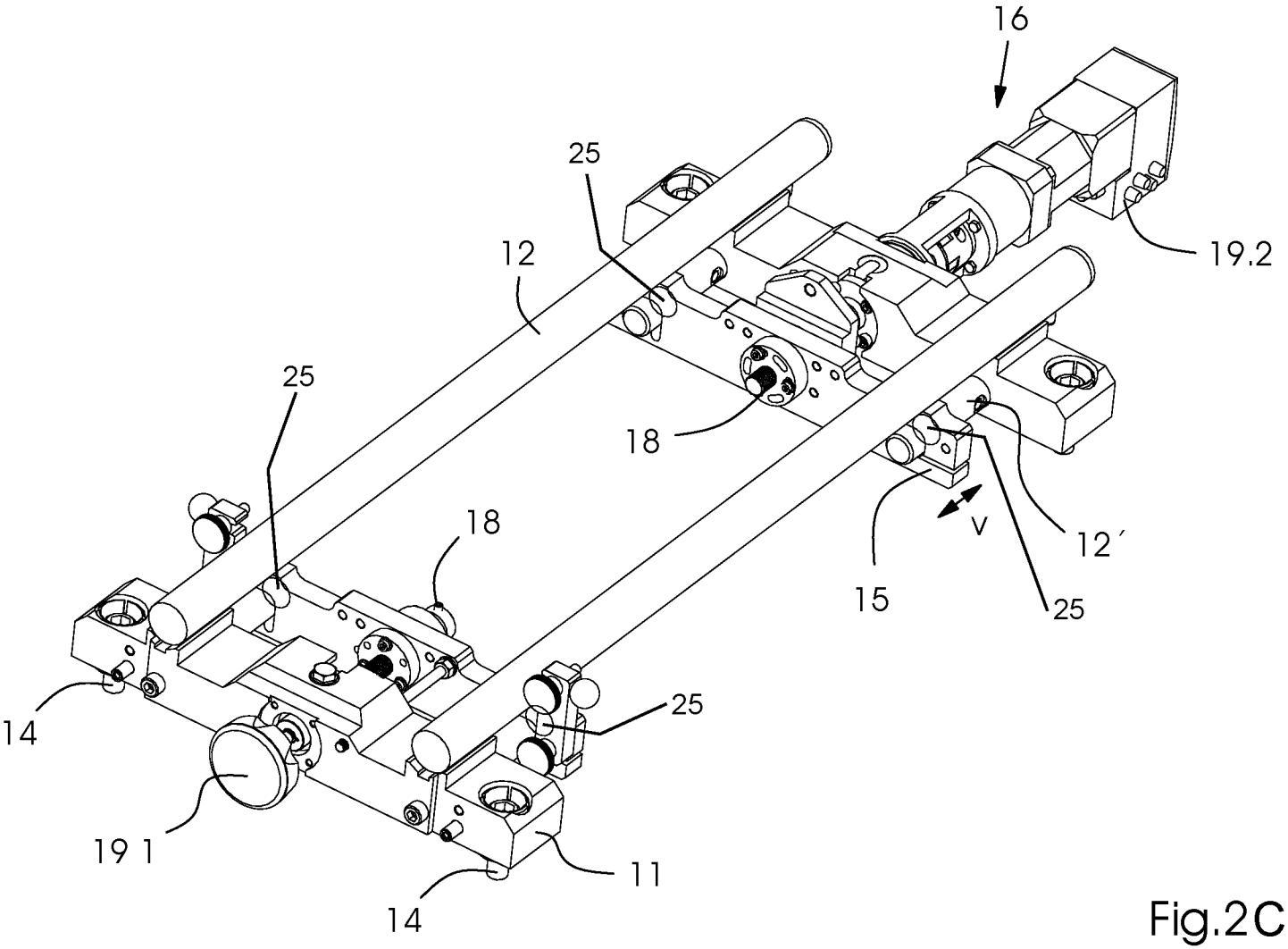
Figure 2D:
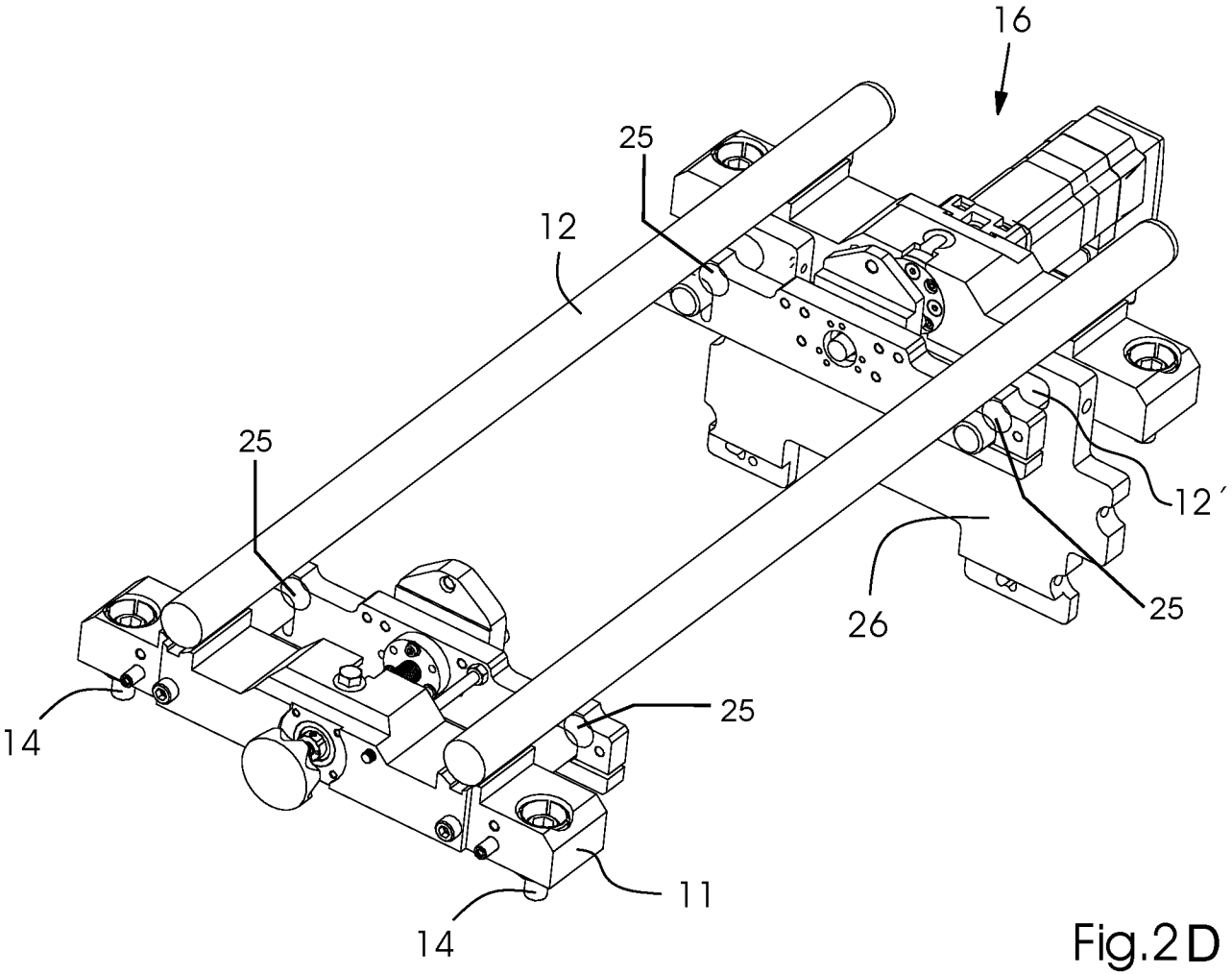

FIGS. 2C and 2D show an embodiment of the invention in which both an adjustment motor 19.2 and a rotary knob 19.1 are provided at opposite ends of the crossbars 12. In addition, it is seen that the carrier modules 10 include crossbar stubs 12' fixed to the longitudinal beams 11 in a direction parallel to the crossbars 12. The processing modules 26 shown in FIG. 2D have upper surfaces and cutouts 25 formed in the upper surfaces for being hooked into the crossbar stubs 12' of the carrier modules 10. The cutouts 25 are complementary to the crossbar stubs 12' and each respective processing module 20 is supported by the crossbar stubs 12' of at least one of the carrier modules 10.

Figure 3:
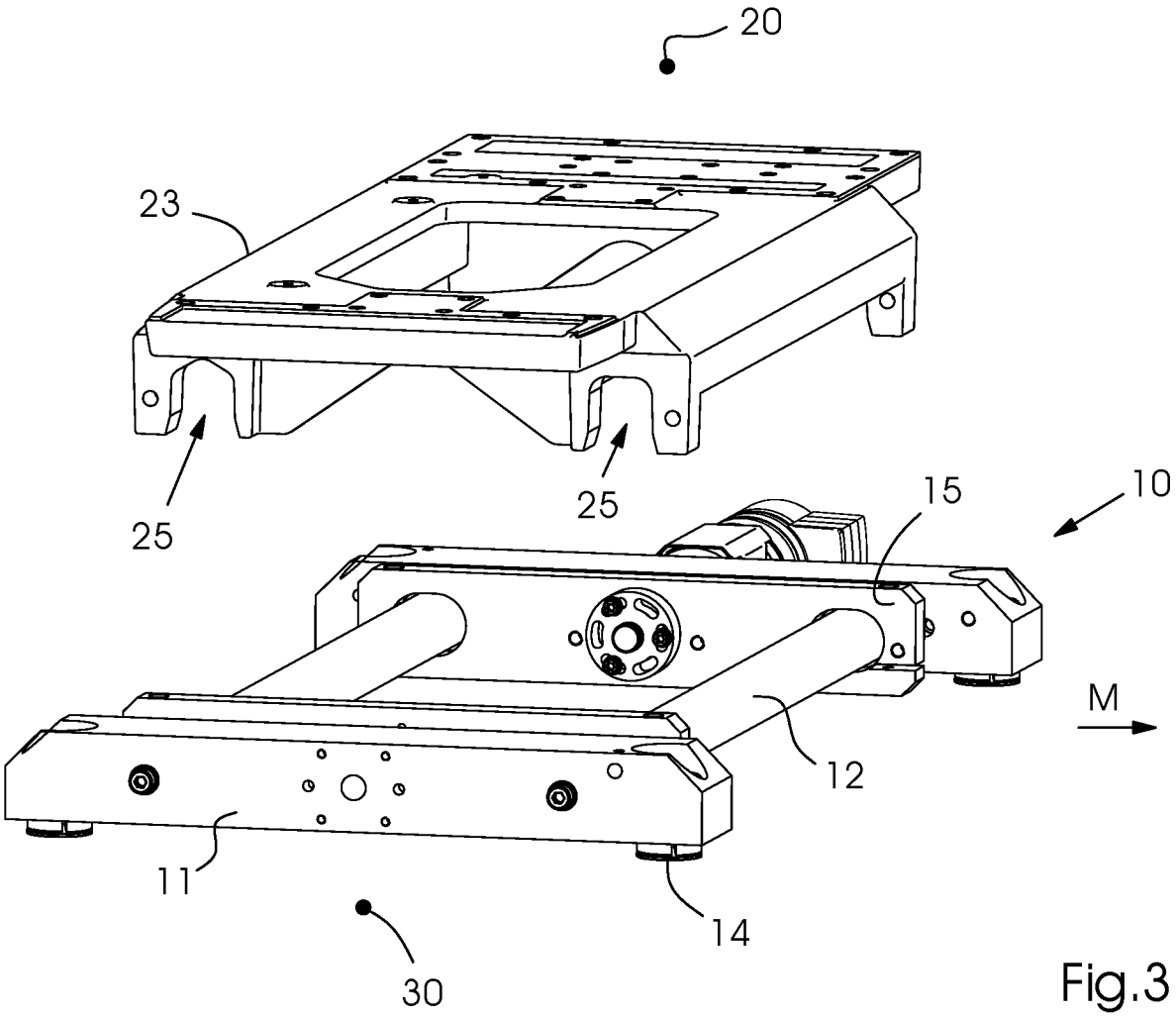
FIG. 3 is an exploded, perspective view illustrating an engagement between crossbars and cutouts as a processing module is inserted.

A processing module 20 is fixed to the positioning rail 15 in order to be able to implement a displacing movement v to position a processing module 20 located on the carrier module 10 and in order to allow an adjustment of the lateral register of the processing module 20. As shown in FIG. 3, boreholes are provided in the longitudinal bar 11 and in the positioning rail 15 to allow a processing tool 20 and the positioning rail 15 to be screwed together.

FIG. 3 further shows how a processing module 20 may be positioned on the machine frame 30 by using the carrier module 10. Cutouts 25 (only two of which are shown) are provided on the underside of every processing module 20. The cutouts 25 are spaced apart from one another and shaped in such a way as to correspond with the crossbars 12 and to allow the crossbars 12 and cutouts 25 to engage with one another. In other words, the cutouts 25 and the crossbars 12 are constructed to complement one another. In the embodiment shown in FIG. 3, the cutouts 25 are formed in a carrier plate 23 and the carrier plate 23 may carry a processing module 20. The two cutouts 25 that correspond with the left-hand crossbars 12 have an approximately prismatic shape. This is to say that contacting surfaces are provided that ensure a defined support of the carrier plate 23 on the left-hand crossbar 12 in a defined way. The two cutouts 25 that correspond with the right-hand crossbars 12 have a different construction. They include a horizontal contact surface for supporting the carrier plate 23 on the crossbars 12 in a defined way. However, in the machine direction M, the two cutouts 25 are large enough to allow a certain amount of play between the crossbars 12 and the vertical surfaces of the cutout. This avoids an over-determinate supporting of the carrier plate 23.

Figure 4:
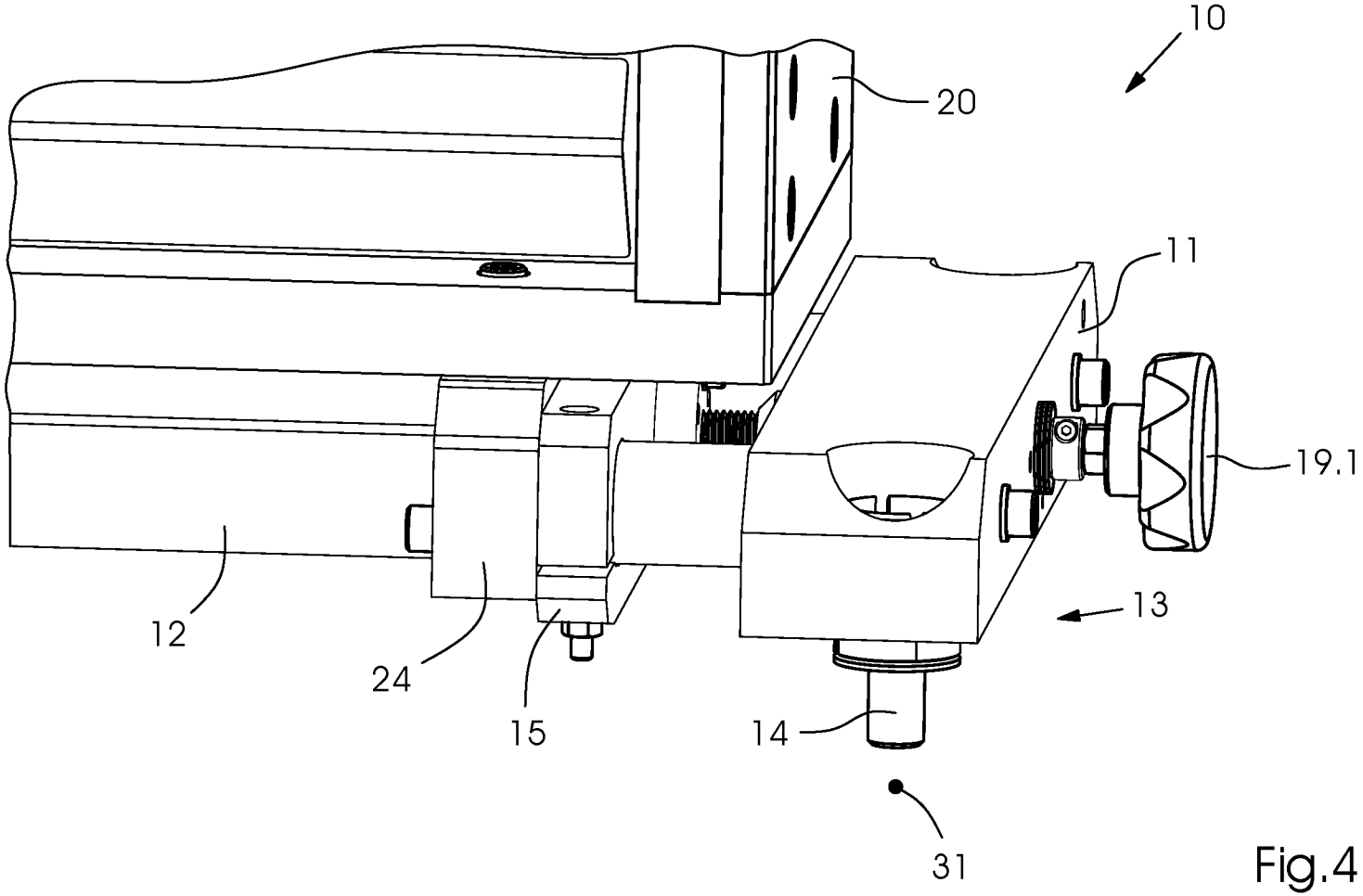
FIG. 4 is a fragmentary, perspective view of a support system of a carrier module.

As an alternative shown in FIG. 4, adapters 24 may be screwed to the processing modules 20 instead of using a carrier plate 23 to support the processing modules 20. In this case, the cutouts 25 corresponding with the crossbars 12 are formed in the adapters 24.

FIG. 4 also includes a more detailed representation of the support system 13 for fixing the carrier module 10 to the side walls 31 of the machine frame 30. For this purpose, the support system 13 has four leveling elements 14, which are integrated into the two longitudinal beams 11 at the four corners of the carrier module 10. The position of the leveling elements 14 will become apparent from FIGS. 1, 2A, and 2B.

A respective leveling element 14 may include a minimum of a large slotted threaded sleeve and an adjustment screw to form a screw connection with the machine frame 30 or the side wall 31 thereof. The threaded sleeve of the leveling element 14 includes a lower contact surface that contacts a surface of the side wall 31 so as to be flush therewith. An adjustment or leveling of the carrier module 10 is achieved by rotating the threaded sleeve. In this process, the outer thread of the threaded sleeve moves in an interior thread cut into the longitudinal beam 11. Once the leveling process is completed, the cylinder screw is tightened to prevent the threaded sleeve from rotating any further and to firmly screw the longitudinal beam 11 and the side wall 31 together.

Figure 5A:
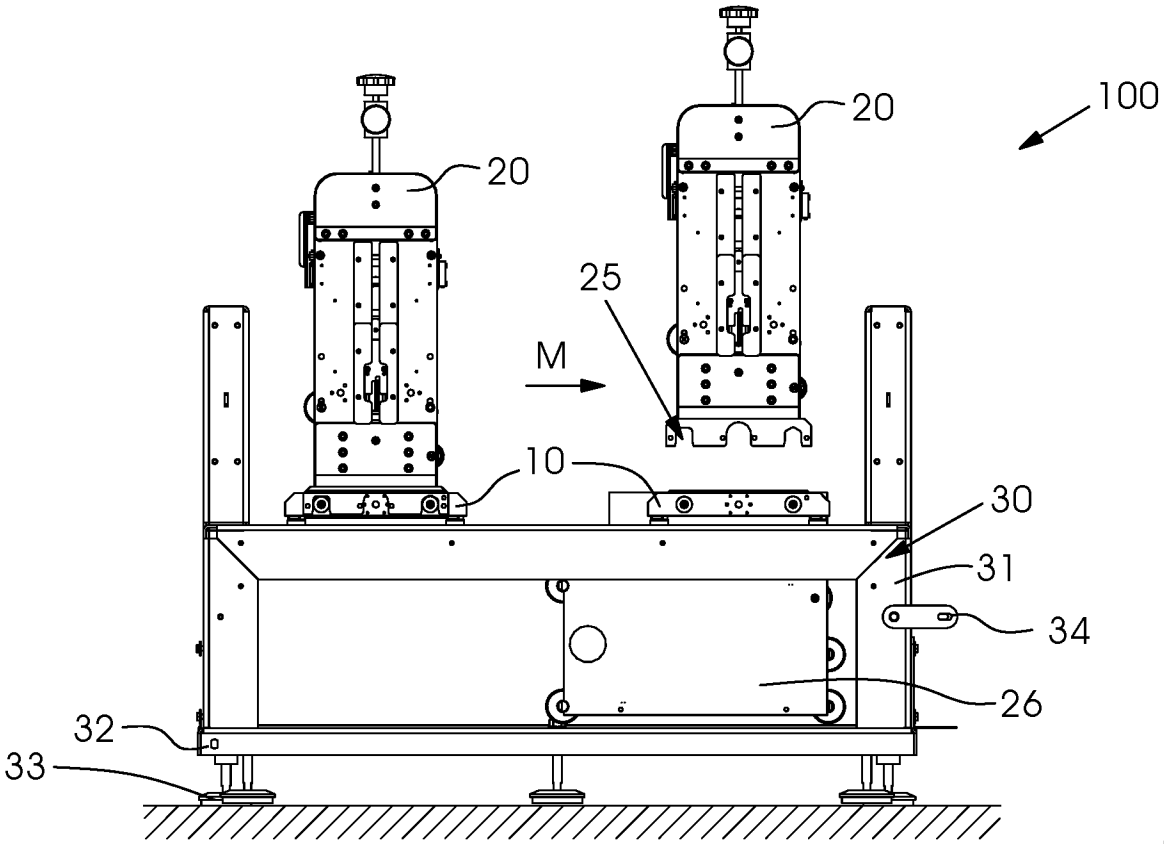
FIGS. 5A and 5B are elevational views illustrating how the processing modules are supported in the machine frame.
Figure 5B:
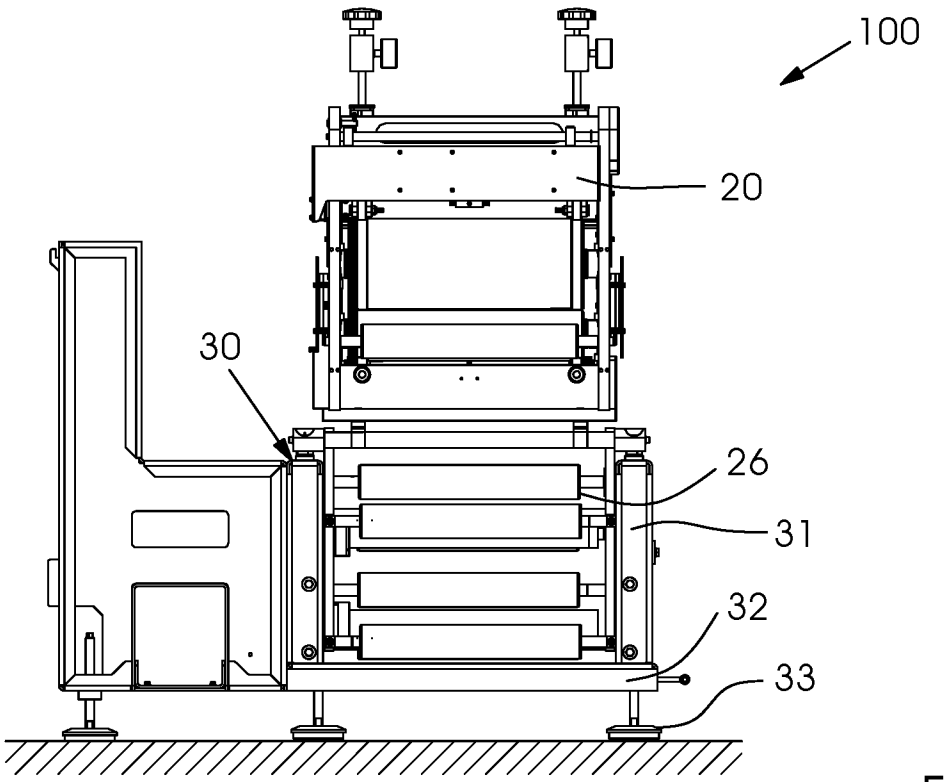

FIGS. 5A and 5B illustrate the construction of the machine frame. The machine frame 30 of the web-fed printing machine 100 may be formed of a plurality of frame elements as shown in FIGS. 5A and 5B. The frame elements may be interconnected by coupling rods or connecting links 34. A respective frame element is formed of a welded sheet-metal frame construction having two parallel side walls 31 mounted to a base plate 32. The base plate 32 has legs 33 for a coarse alignment of the frame element. The sheet-metal frame construction of the side walls 31 has upper contact surfaces for supporting the carrier modules 10. Processing modules 20 may be placed on the carrier modules 10 from above. In addition or alternatively, other processing modules 20 may be hooked into the carrier modules 10 from below, for instance processing modules 26 in the form of driers that include a plurality of rollers, resulting in a suspended configuration of the processing modules 26. If the processing modules 26 that have been introduced from below do not snap onto the crossbars 12, it may be necessary to provide a screw connection between the processing modules 26 and the carrier modules 10.

Figure 6:
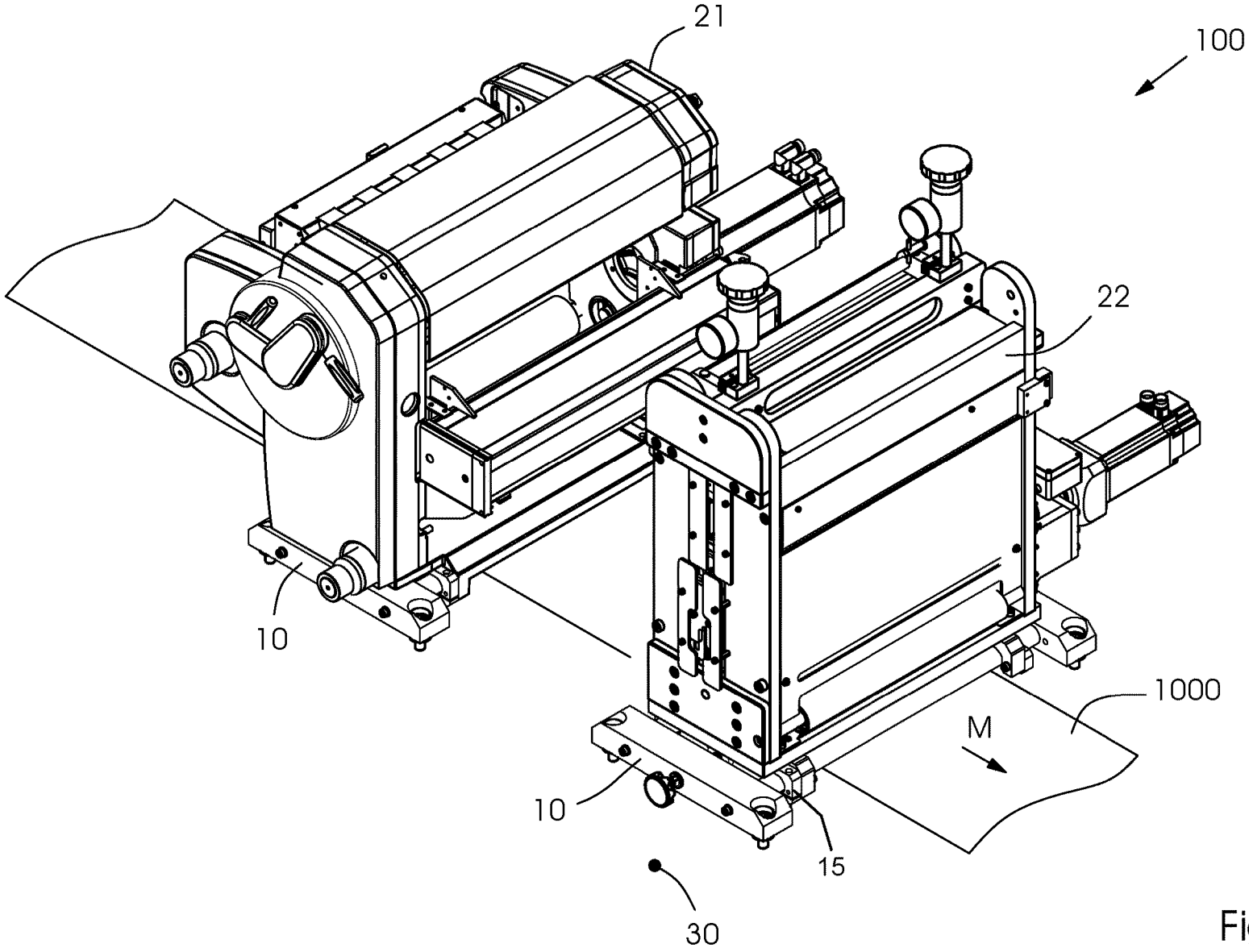
FIG. 6 is a perspective view illustrating two examples of processing modules that are each carried by a respective carrier module.

By way of example, FIG. 6 illustrates a flexographic printing unit 21 and a rotary diecutting unit 22 in a web-fed printing machine 100 for processing a substrate web 1000 that is transported in the machine direction M. The processing modules 21, 22 are disposed on the non-illustrated machine frame 30 by using carrier modules 10, which have positioning rails 15.

The invention claimed is:

1. A web-fed printing machine for printing on a substrate web being transported through the web-fed printing machine in a machine direction and processed, the machine comprising:

a machine frame;

a plurality of processing modules;

carrier modules each fixing a respective one of said processing modules to said machine frame;

each of said carrier modules including two mutually parallel longitudinal beams extending in the machine direction and two mutually parallel crossbars oriented at right angles to said longitudinal beams, said two crossbars interconnecting said two longitudinal beams;

each respective one of said processing modules being supported by said crossbars of at least one of said carrier modules;

said processing modules having upper surfaces and cutouts formed in said upper surfaces for being hooked into crossbar stubs of said carrier modules, said cutouts being complementary to said crossbar stubs; and said longitudinal beams being supported by said machine frame.

2. The web-fed printing machine according to claim 1, which further comprises a support system, each of said carrier modules being fixed to said machine frame and configured to be leveled by said support system.

3. The web-fed printing machine according to claim 2, wherein said support system has adjustable self-locking leveling elements.

4. The web-fed printing machine according to claim 1, wherein said machine frame includes at least a base plate and two parallel side walls of identical height.

5. The web-fed printing machine according to claim 4, wherein said base plate and said side plates form a welded sheet-metal structure.

6. A web-fed printing machine for printing on a substrate web being transported through the web-fed printing machine in a machine direction and processed, the machine comprising:

a machine frame;

a plurality of processing modules;

carrier modules each fixing a respective one of said processing modules to said machine frame;

each of said carrier modules including two mutually parallel longitudinal beams extending in the machine direction and two mutually parallel crossbars oriented at right angles to said longitudinal beams, said two crossbars interconnecting said two longitudinal beams;

each respective one of said processing modules being supported by said crossbars of at least one of said carrier modules;

said longitudinal beams being supported by said machine frame;

a positioning rail supported on said crossbars of one of said carrier modules, said positioning rail being movable in a transverse direction in order to position a respective one of said processing modules.

7. The web-fed printing machine according to claim 6, which further comprises spindle drives each being provided on a respective one of said carrier modules for adjusting a positioning rail.

8. The web-fed printing machine according to claim 7, wherein each of said spindle drives includes a spindle, a spindle nut, and a manually operated knob or a controllable electric motor.

9. A web-fed printing machine for printing on a substrate web being transported through the web-fed printing machine in a machine direction and processed, the machine comprising:

a machine frame;

a plurality of processing modules;

carrier modules each fixing a respective one of said processing modules to said machine frame;

each of said carrier modules including two mutually parallel longitudinal beams extending in the machine direction and two mutually parallel crossbars oriented at right angles to said longitudinal beams, said two crossbars interconnecting said two longitudinal beams;

each respective one of said processing modules being supported by said crossbars of at least one of said carrier modules;

said longitudinal beams being supported by said machine frame;

crossbar stubs being disposed on said longitudinal beams and being parallel to said crossbars; and a positioning rail being supported on said stubs, said positioning rail being movable in a transverse direction in order to position a respective one of said processing modules.

10. The web-fed printing machine according to claim 9, which further comprises spindle drives each being provided on a respective one of said carrier modules for adjusting a positioning rail.

11. The web-fed printing machine according to claim 10, wherein each of said spindle drives includes a spindle, a spindle nut, and a manually operated knob or a controllable electric motor.

12. A web-fed printing machine for printing on a substrate web being transported through the web-fed printing machine in a machine direction and processed, the machine comprising:

a machine frame;

a plurality of processing modules;

carrier modules each fixing a respective one of said processing modules to said machine frame, each of said carrier modules including two mutually parallel longitudinal beams extending in the machine direction, two mutually parallel crossbars oriented at right angles to said longitudinal beams and interconnecting said longitudinal beams, and crossbeam stubs fixed to said longitudinal beams in a direction parallel to said crossbars;

said processing modules having surfaces and cutouts formed in said surfaces for being hooked into said crossbeam stubs of said carrier modules, said cutouts being complementary to said crossbars;

each respective processing module being supported by said crossbeam stubs of at least one of said carrier modules; and said longitudinal beams being supported by said machine frame.

* * * * *